US005787807A

United States Patent [19]

Rodi

[11] Patent Number: 5,787,807

[45] Date of Patent: Aug. 4, 1998

[54] SHEET-FED ROTARY PRINTING PRESS WITH DIGITAL IMAGING

[75] Inventor: Anton Rodi, Leimen, Germany

[73] Assignee: Heidelberger Druckmaschinen AG, Heidelberg, Germany

[21] Appl. No.: 812,100

[22] Filed: Mar. 5, 1997

Related U.S. Application Data

[63] Continuation-in-part of Ser. No. 700,612, Aug. 12, 1996, abandoned, which is a continuation of Ser. No. 442,789, May 17, 1995, abandoned.

[30] Foreign Application Priority Data

May 17, 1994 [DE] Germany ..... 44 17 177.3

[51] Int. Cl.[6] ..... B65H 9/04

[52] U.S. Cl. ..... 101/211; 101/483

[58] Field of Search ..... 101/211, 183, 101/181, 216, 248, 219, 232, 483, 471, 470, 163

[56] References Cited

U.S. PATENT DOCUMENTS

| | | | |
|---|---|---|---|
| 3,835,776 | 9/1974 | Weidman | 101/248 |
| 4,718,340 | 1/1988 | Love, III . | |
| 4,729,310 | 3/1988 | Love, III . | |
| 4,827,315 | 5/1989 | Wolfberg et al. . | |
| 5,115,493 | 5/1992 | Jeanblanc et al. . | |
| 5,136,316 | 8/1992 | Punater et al. . | |
| 5,163,368 | 11/1992 | Pensavecchia et al. | 101/183 |
| 5,327,826 | 7/1994 | Rodi | 101/181 |
| 5,533,453 | 7/1996 | Wolfberg et al. . | |

*Primary Examiner*—Eugene H. Eickholt

*Attorney, Agent, or Firm*—Herbert L.. Lerner; Laurence A. Greenberg

[57] ABSTRACT

Sheets of defined format lengths are printed in a sheet-fed rotary printing press with a plurality of printing units. Each of the printing units includes an impression cylinder and a counter-pressure cylinder. The two cylinders define a printing nip and the printing units are disposed such that a sheet travels through the printing nips in succession. The impression cylinders have a circumference which is no longer, and preferably shorter, than a shortest format length of the sheet. The impression cylinders are disposed such that mutually adjacent printing nips of adjacent printing units are spaced at a distance which is shorter than the shortest format length to be printed. The impression cylinders have a circumferential surface carrying a subject or motif to be printed. The images printed on printing material therefrom have an image spacing between one another. The circumference of the impression cylinder is smaller than the sum of the image length and the length of the image spacing.

10 Claims, 3 Drawing Sheets

SHEET-FED ROTARY PRINTING PRESS WITH DIGITAL IMAGING

CROSS-REFERENCE TO RELATED APPLICATION

This application is a continuation-in-part of application Ser. No. 08/700,612, filed Aug. 12, 1996, now abandoned which was a continuation of application Ser. No. 08/442,789, filed May 17, 1995, now abandoned.

BACKGROUND OF THE INVENTION

Field of the Invention

The invention relates to a plateless printing system in which a peripheral surface of the impression cylinder is continuously digitally re-imaged and the ink is completely transferred to the sheet surface; the invention further pertains to an impression cylinder of a printing press having, on the outer cylindrical surface thereof, a subject or motif to be printed which has an image length in a longitudinal printing direction, and an image width transverse to the image length, so that subjects or motifs printed therefrom on printing material have an image spacing between one another.

Impression cylinders of conventional printing presses have an outer cylindrical or circumferential surface which, when unwound, corresponds to the maximum image length of a subject or motif to be printed in addition to a minimum image spacing. The latter is determined by the size of a lock-up gap which serves for clamping a printing plate on the outer periphery of the impression cylinder. If a subject or motif is to be printed which has an image length smaller than the maximum image length, an image spacing is formed which is greater than a minimum spacing, the sum of the image length and the image spacing thereby always corresponding to the circumference of the impression cylinder, altogether determining the so-called characteristic phase, i.e. the resonant phase, of the printing press. Printing presses are conventionally built in accordance with the principle that the cylinder diameter thereof corresponds or is set for a maximum image length which is to be printed. A functional dependency is thus formed with respect to the length of the format, especially conditioned upon or determined by the fact that the costs of the printing material, such as paper, for example, constitute substantially 70% of the incidental costs for the printing.

A very important factor in the printing art is the size of the printing press. The size of the printing press frame and the housing, as well as the building surrounding the printing press, are largely determined by the size of the various rollers, including at least one impressing cylinder per printing unit, and the travel path between the rollers.

The minimum conceivable spacing between central axes of mutually adjacent impression cylinders logically corresponds to the diameter of the impression cylinders. Two factors must be taken into consideration: First, the maximum image size (plus the gap between images) could not be any greater in the prior art than the circumference of the impression roller. Second, it is a geometrically dictated fact that the minimum spacing between two roller nips corresponds to the sum of the radii of the larger rollers (of the pair of rollers forming the nip). These factors necessitated a multiplicity of gripping and clamping devices for holding the sheet in register while the sheet travels between the impression cylinders. Besides the increased structural and spatial expense, the additional grippers and the like also added to the possibility of register deviations and shifting of the sheets.

SUMMARY OF THE INVENTION

It is an object of the invention to reduce the size of the printing press as a whole and to overcome the geometrically dictated necessity for the additional grippers and the like. It is a further object of the invention to provide a system of multi-color printing units which allows a substantial reduction in the size of the printing press and which does away with the need for auxiliary gripping and registration devices between the respective impression cylinders of the printing press, and which thereby simplifies the sheet transport between the printing units. Besides space and component reduction, it is important to provide for optimal press management.

With the foregoing and other objects in view, there is provided, in accordance with the invention, a sheet-fed rotary printing press for printing sheets of defined image lengths, including a shortest image length, comprising:

a plurality of printing units each including an impression cylinder and a counter-pressure cylinder defining a printing nip therebetween, the printing units being disposed such that a sheet travels through respective the printing nips in succession;

each of the impression cylinders having a circumference no longer than a shortest image length to be printed in the printing units; and the impression cylinders being disposed such that mutually adjacent printing nips of respective the printing units are spaced at a distance shorter than the shortest image length to be printed.

In accordance with another feature of the invention, each of the impression cylinders has a circumference shorter than the shortest image length to be printed.

There is also provided, in accordance with one aspect of the invention, an impression cylinder of a printing press having a circumferential surface and comprising a subject or motif to be printed which is disposed on the circumferential surface and has a image length and a image width transverse to the image length, so that subjects or motifs printed on printing material therefrom have an image spacing between one another, the circumference of the impression cylinder being smaller than the sum of the image length and the length of the image spacing.

In accordance with another feature of the invention, the circumference of the impression cylinder is at most equal to the image length.

In accordance with a further feature of the invention, the circumference of the impression cylinder is smaller than the image length.

In accordance with an additional feature of the invention, ink which is free of residue is transferable by the impression cylinder to the printing material or stock.

In accordance with yet another feature of the invention, information for producing the subject or motif is continuously recordable on the impression cylinder.

In accordance with another aspect of the invention, there is provided a method of printing subjects or motifs having a image length and a image width transverse to the image length, the printed subjects or motifs having an image spacing between one another, which comprises installing an impression cylinder in a printing press for printing the subjects or motifs, the impression cylinder having a circumference which is smaller than the sum of the image length and the length of the image spacing or smaller than or equal to the image length.

In accordance with a concomitant mode, the method of the invention includes installing such an impression cylinder having a circumference which is smaller than a maximum image length in addition to the image spacing and greater than a minimal image length in addition to the image spacing.

There is described a method of printing sheets in a sheet-fed rotary printing press having a plurality of printing units, which comprises: conveying a sheet in a conveying direction through a plurality of printing units each having a printing nip in which ink is transferred to the sheet for creating an image on the sheet; and clamping a leading edge of the sheet in the printing nip of one printing unit, while a trailing edge of the same sheet is still clamped in the printing nip of a preceding printing unit as seen in the conveying direction.

Finally, the method further comprises digitally and continuously reimaging the impression cylinders in the respective printing units.

In providing that the circumference of the impression cylinder be smaller than the sum of the image length and the image spacing, no functional dependence, in the presented sense, between the the circumference of the impression cylinder and the sum of the image length and the image spacing is supposed to exist, i.e., the so-called phase resonance or characteristic phase is surrendered or abandoned. The image is transfered to the printing material during the rotation of the impression cylinder, while a continuous interpolation takes place, i.e., the information to be printed is produced on the jacket surface of the impression cylinder during the rotation or revolution thereof, due to which it is possible to print a selective image length of the subject or motif on the printing material or stock, the maximum length of which is not determined by or conditioned upon the circumference of the impression cylinder. It is also possible to produce a great image length with very small impression cylinder-diameter subjects or motifs, the breadth of the image spacing further being selectable so that, independently of the image length, no waste occurs, but rather, is only so great that, for example, in a web-fed rotary printing press, a cutting operation for separating the individual subjects or motifs can take place.

By providing for ink free of residue to be transferable by the impression cylinder to the printing material or stock, assurance is given that, during the continuous recording of printing information, a clean subject or motif will be printed. Also, the novel system according to the invention transfers the ink completely, i.e. the ink is not split between the ink carrier and the printed product.

Other features which are considered as characteristic for the invention are set forth in the appended claims.

Although the invention is illustrated and described herein as embodied in a sheet-fed rotary printing press with digitally imaged impression cylinders and method of printing therewith, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
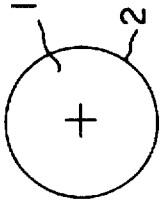
FIG. 1 is a diagrammatic end view of an impression cylinder according to the invention.
Figure 2:
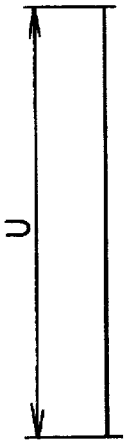
FIG. 2 is a diagrammatic extended or unwound view of the circumference of the impression cylinder of FIG. 1.

Referring now to the figures of the drawing and, first, particularly to FIG. 1 thereof, there is shown therein diagrammatically an impression cylinder 1 having a jacket or outer cylindrical surface S of given circumference. As shown in FIG. 2, in a developed view of the jacket surface 2, the circumference is seen to have a length U.

The impression cylinder 1 permits a consecutive printing of information for producing an image on a printing material, such as paper, for example. In other words, the impression cylinder is continuously reimaged and can, therefore, during the rotation thereof, be recordable with updated information which can also be erased immediately after printing has taken place and before the corresponding location of the jacket surface again comes into contact with the printing material or stock. Real-time digital imaging is described, for instance, in U.S. Pat. No. 4,792,860 to Kuehrle, which is herein incorporated by reference.

In contrast with conventional offset printing, which generally utilizes ink-division between the ink-carrier and the printing product, real-time imaging utilizes direct and complete ink transfer from the impression cylinder to the printing product. In other words, a given location on the impression cylinder may carry a different dot pattern of a different thickness for each revolution.

Figure 3:
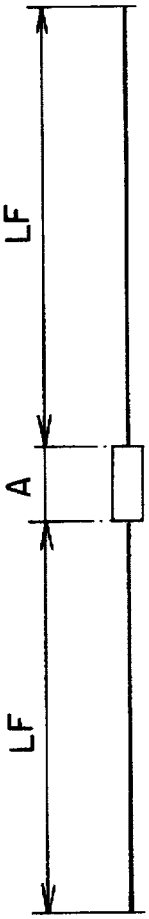
FIG. 3 is a diagrammatic extended or unwound view of two image lengths with an image spacing therebetween, each of the image lengths being smaller than the length of the circumference in FIG. 2.

In accordance with the invention, as shown in FIG. 3, the circumference U of the impression cylinder 1 may be smaller than the sum of a image length $L_F$ of a subject or motif and an image spacing A to an adjacent subject or motif having the image length $L_F$.

Theoretical limits in terms of the size reduction of the impression cylinders are determined only by the computing speed of the imaging system. Mechanical limits further take into consideration the actual ink transfer speed (from the ink source to the various microcells on the cylinder surface and from the impression cylinder to the paper), as well as the angular velocity limits of the rollers.

Figure 4:
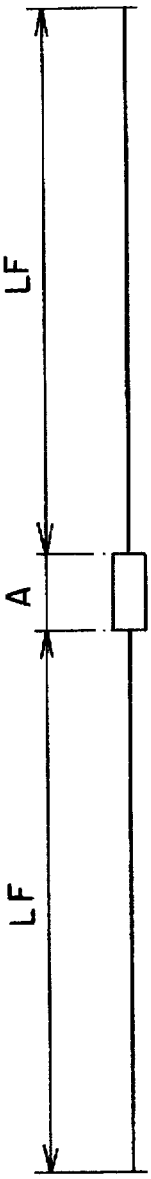
FIG. 4 is a view similar to that of FIG. 3, however, with each of the image lengths being greater than the length of the circumference.

Further in accordance with the invention, as shown in FIG. 4, the image length $L_F$ of the subject or motif may be greater than the circumference U of the impression cylinder 1. The image spacing A is further added to the foregoing image length $L_F$ and is followed, in turn, by the image length $L_F$ of the adjacent subject or motif.

Assurance is thereby especially provided that the impression cylinder 1 does not determine or establish any maximum format in addition to a minimum spacing which is to be taken into account, but rather, that no dependency upon the diameter of the impression cylinder 1 exists. The phase resonance of prior art printing is thus dispensed with, i.e. the invention does not deal with the typical 1:1, 1:2, 1:3 relationships between the impression cylinder circumference and the sheet format.

Figure 5:
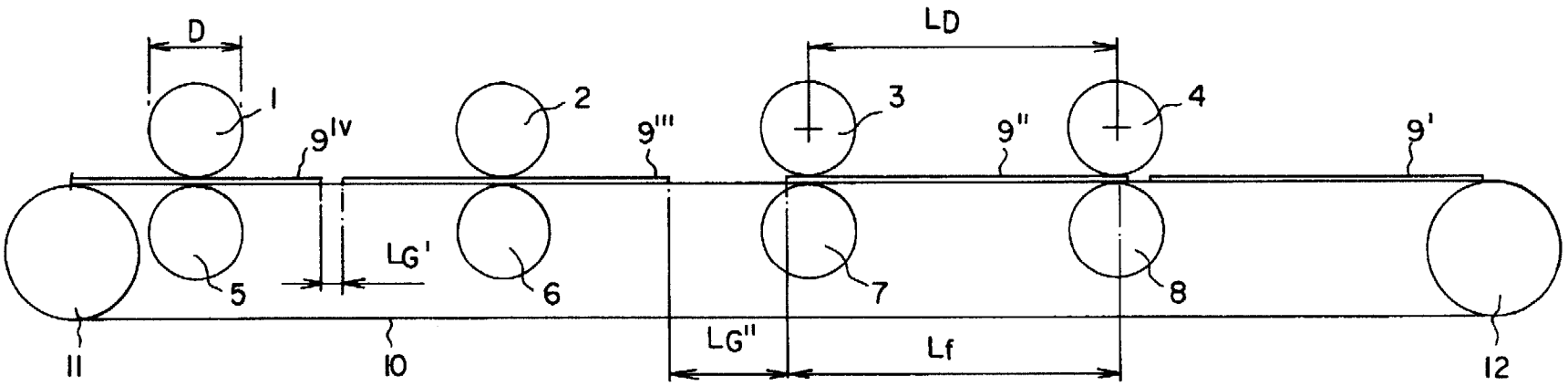
FIG. 5 is a diagrammatic side view of a sheet-fed printing press with four printing units.

Referring now to FIG. 5, a sheet-fed rotary printing press is illustrated highly diagrammatically which makes use of the above-described impression cylinder. All of the printing press components, such as a feeder, a delivery, and the various subunits within the printing units are conventional and are, therefore, not illustrated. As will be seen from the following description, the novel features herein are found in the size and spacing of the impression cylinders and the various printing units.

A conveyor belt 10 transports a paper sheet 9 through the individual printing units. The endless conveyor belt 10 is deflected about terminal guide rollers 11 and 12. It is also possible to provide individual conveyors between the various printing units, or even rigid surfaces which are provived with blowing air nozzles forming an air transport pattern. The printing units are only diagrammatically indicated in FIG. 5. Only the respective impression cylinders 1–4 are illustrated with which the ink is transferred onto the paper sheet 9 and the respective counter-pressure cylinders 5–8. The impression cylinders are completely free of any interruption on their circumferential surface. In other words, the digital imaging system herein allows to do away with any clamping grooves otherwise necessary for holding printing plates on the plate cylinders. A full 360° surface of the impression cylinder is available for ink transfer.

It is possible in the embodiment of FIG. 5 to print any format, from image sizes which are much shorter than the cylinder circumference to essentially endless print. It is further possible to print different images and formats for each subsequent sheet 9. For example, the sheet 9 may be printed with a format A, while the following sheet 9' is printed with a smaller format B.

Any arbitrary spacing $L_G$ or $L_{G''}$ may be selected between two paper sheets according to the novel system. The circumference ($U=2r\pi=D\pi$) of the cylinders 1–4 is preferably chosen such that the smallest format to be printed (e.g. A4 or smaller) requires more than a full revolution (360°) of the impression cylinder. The spacing $L_D$ between individual printing units is chosen to be smaller than the shortest possible length $L_f$ of the paper format to be printed ($L_D<L_f$). In the theoretical extreme, the spacing $L_D$ corresponds to the cylinder diameter D ($L_D \geqq D$). The important and advantageous result is that the paper sheet 9 is always clamped in at least one roller nip between the impression cylinders 1–4 and a respective counter-pressure cylinder 5–9. The paper sheet 9 cannot shift out of register in between printing units.

The printing and transport operation of FIG. 5 is as follows:

The paper sheet 9 lies on the conveyor belt 10 and it is held on the conveyor belt for instance by means of electrostatic forces. The sheet is transported into and through the nip formed between the impression cylinder 4 and the counter-pressure cylinder 8. Ink is transferred from the impression cylinder 4 to the paper sheet 9' as the sheet travels through the nip. The ink is fully transferred from each of the microcells on the impression cylinder to the sheet 9'. In addition to the electrostatic force holding the sheet on the conveyor belt 10, the sheet 9' is also held in the nip 4/8 through which it travels. As the sheet 9 leaves the nip 4/8, its leading edge has already been clamped in the nip 3/7 of the following printing unit, where the sheet is printed with another ink. The trailing edge of the sheet 9" leaves the nip 4/8 only after the leading edge of the sheet 9" is already safely clamped in the nip 3/7. As illustrated, no sheet is ever transported between the printing units, without being clamped in at least one nip in addition to the holding force provided on the conveyor belt 10.

Figure 6:
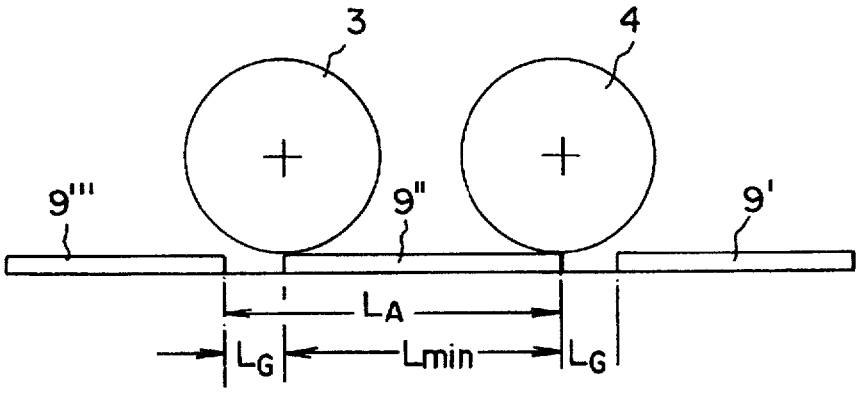
FIG. 6 is a similar view showing two adjacent impression rollers and a sheet clamped by the two rollers.
Figure 7:
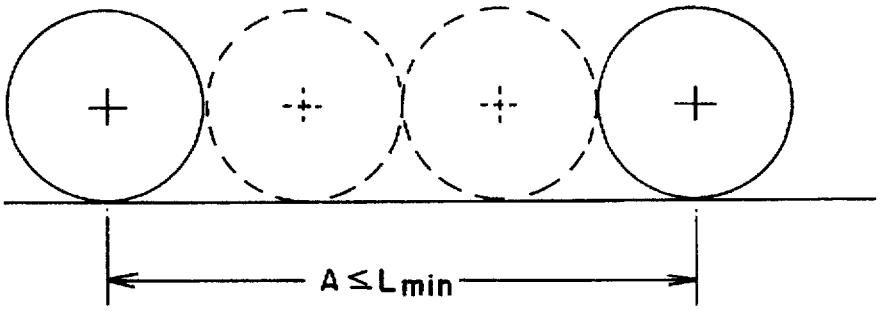
FIG. 7 is a similar view illustrating a maximum cylinder spacing.
Figure 8:
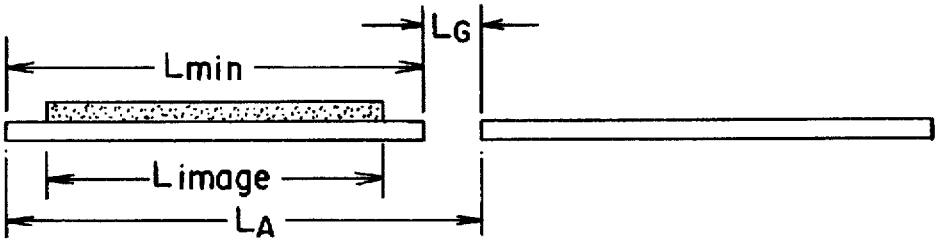
FIG. 8 is a diagrammatic view illustrating various pertinent lengths, including a format length, and image length, and a gap length.

With reference to FIGS. 6 and 7, a sheet with a length $L_{min}$ is simultaneously clamped in the nips of both successive printing rollers 1. The minimum format length $L_{min}$ must thereby satisfy the equation $$\frac{D}{2}+\frac{D}{2}=D \leqq L_{min},$$

where D is the diameter of the printing roller 1. A further relationship is the circumference $U=D\pi \leqq L_{max}$. As shown in FIG. 7, the spacing A between two mutually adjacent rollers will not exceed two times the roller diameter, so that $D<A<L_{min}$. The forgoing equations lead to $$L_{min} \leqq D\pi \leqq L_{max} \text{ and } \frac{L_{min}}{\pi} \leqq D \leqq \frac{L_{max}}{\pi},$$

where $\leqq$ may be replaced with < in the extreme case.

The resultant system is characterized with a very compact structure incorporating the entire machine, the printing cylinders and the auxiliary system components. The system is properly dimensioned for high-volume production printing. A minimum format is easily defined and essentially no limit needs to be preset for the maximum format and image length. Print quality is easily ensured with regard to the entire format and the system is variable with regard to format and sheet spacing.

In a preferred embodiment, the cylinders are driven with freely programmed electrical shafts, so that exact register synchronization is easily maintained. Register maintenance is still an important consideration, even though each sheet is continuously clamped in at least one nip during its travel through the printing machine, and real-time paper slippage can still occur.

$L_{min}$ refers to the minimum paper format length which can be processed in the printing machine. $L_{max}$ refers to the maximum format length which can be printed in the system. $L_G$ is the sheet spacing, i.e., a distance between the leading edge of the following sheet and the trailing edge of the preceding sheet. The spacing $L_G$ is a variable distance. LA defines the phase of the machine, and $L_{image}$ is the length of the image to be printed onto the sheet. $L_{image}$ is no longer than the format length and it will usually be shorter.

I claim:

1. A sheet-fed rotary printing press for printing sheets of defined format lengths, including a shortest format length and a longest format length, comprising:

a plurality of printing units for printing a plurality of colors, each of said printing units including an impression cylinder and a counter-pressure cylinder defining a printing nip therebetween, said printing units being disposed such that a sheet travels through respective said printing nips in succession;

each of said impression cylinders having a circumference shorter than the longest format length and equal to or longer than a shortest format length to be printed in said printing units.

2. The printing press according to claim 1, wherein said impression cylinders are disposed such that mutually adjacent printing nips of respective said printing units are spaced apart a distance shorter than the shortest image length to be printed, such that a sheet traveling between adjacent said printing units is at any time clamped within at least one of the printing nips.

3. The printing press according to claim 1, wherein each of said impression cylinders has a circumferential surface, and comprising a subject or motif to be printed which is disposed on the circumferential surface and has a image length and a image width transverse to the image length, so that subjects or motifs printed on printing material therefrom have an image spacing between one another, the circumference of the impression cylinder being smaller than the sum of said image length and the length of said image spacing.

4. The printing press according to claim 3, wherein the circumference of the impression cylinder is smaller than said image length.

5. The printing press according to claim 1, wherein ink which is free of residue is completely transferable from said impression cylinder to a printing material or stock.

6. The printing press according to claim 1, wherein said impression cylinders are continuously reimaged.

7. The printing press according to claim 1, wherein said impression cylinders are digitally reimaged.

8. A method of printing sheets in a sheet-fed rotary printing press having a plurality of printing units, which comprises:

conveying a sheet in a conveying direction through a plurality of printing units each having a printing nip in which ink is transferred to the sheet for creating an image on the sheet;

clamping a leading edge of the sheet in the printing nip of one printing unit, while a trailing edge of the same sheet is still clamped in the printing nip of a preceding printing unit as seen in the conveying direction; and digitally and continuously reimaging impression cylinders in the respective printing units.

9. A method of printing sheets in a sheet-fed rotary printing press having a plurality of printing units, which comprises:

conveying a sheet in a conveying direction through a plurality of printing units each having a printing nip in which ink is transferred to the sheet for creating an image on the sheet;

clamping a leading edge of the sheet in the printing nip of one printing unit, while a trailing edge of the same sheet is still clamped in the printing nip of a preceding printing unit as seen in the conveying direction; and printing a sheet of a maximum image length and a minimum image length with an impression cylinder having a circumference which is smaller than the maximum image length and greater than a minimum image length.

10. A sheet-fed rotary printing press for printing sheets of defined format lengths, including a shortest format length, comprising:

a plurality of printing units for printing a plurality of colors, each of said printing units including an impression cylinder and a counter-pressure cylinder defining a printing nip therebetween, said printing units being disposed such that a sheet travels through respective said printing nips in succession;

said impression cylinders being disposed such that mutually adjacent printing nips of respective said printing units are spaced apart a distance shorter than the shortest image length to be printed, such that a sheet traveling between adjacent said printing units is at any time clamped within at least one of the printing nips.

* * * * *